US005417580A

United States Patent [19]

Tsai

[11] Patent Number: 5,417,580

[45] Date of Patent: May 23, 1995

[54] ELECTRONIC CONNECTOR WITH QUICKLY FASTENING LATCHES

[76] Inventor: Wen-Hua Tsai, c/o Hung Hsing Patent Service Center P.O. Box 55-1670, Taipei (104), Taiwan, Prov. of China

[21] Appl. No.: 229,907

[22] Filed: Apr. 19, 1994

[51] Int. Cl.[6] ..... H01R 13/62

[52] U.S. Cl. ..... 439/328; 439/629

[58] Field of Search ..... 439/296, 59, 62, 326–328, 439/372, 629–637

[56] References Cited

U.S. PATENT DOCUMENTS 4,840,570 6/1989 Mann, Jr. et al. ..... 439/327 X 4,898,540 2/1990 Saito ..... 439/326 X 5,052,942 10/1991 Rauterberg et al. ..... 439/326

5,145,396 9/1992 Yeung ..... 439/326

*Primary Examiner*—Khiem Nguyen

[57] ABSTRACT

An electronic connector includes: a pair of pivotal latches pivotaly mounted on two opposite end portions of the electronic connector, each pivotal latch smoothly engageable with a side recess or opening formed in a right or left end portion of the daughter board, whereby upon a pivotal movement of each latch by biasing each latch sidewardly outwardly to disengage the latch from the daughter board, the daughter board can be easily quickly removed from the connector for maintenance and the like.

4 Claims, 3 Drawing Sheets

ELECTRONIC CONNECTOR WITH QUICKLY FASTENING LATCHES

BACKGROUND OF THE INVENTION

In a conventional electronic connector for use in connecting a daughter printed circuit board with a mother printed circuit board, a pair of latches are provided on two opposite end portions of the connector, each latch having a complex engaging structure or mechanism for firmly engaging a right or a left side portion of the daughter board, for clamping the daughter board when inserted in a socket of the connector. Whenever dismantling or removing the daughter board from the connector for maintenance or other purposes, the latches should be forcibly biased sidewardly outwardly for disengaging the latches from the daughter board in order to release the daughter board from the connector, causing inconvenience for maintenance and other manipulation operation.

Meanwhile, the conventional electronic connector has a plurality of contact terminals each terminal embedded in the connector socket for connecting a plurality of terminal pads provided on a lower edge portion of the daughter board.

The contact terminal is arcuately bent to form a spring contact portion such as C shape or other corrugated geometrical shapes in order to firmly clamp the daughter board thereon. However, the spring contact portion has a cross section of rectangular shape having sharp edge portion to easily wear or damage the terminal pads on the daughter board.

SUMMARY OF THE INVENTION

One object of the present invention is to provide an electronic connector including: a pair of pivotal latches pivotaly mounted on two opposite end portions of the electronic connector, each pivotal latch smoothly engageable with a side recess or opening formed in a right or left end portion of the daughter board, whereby upon a pivotal movement of each latch by biasing each latch sidewardly outwardly to disengage the latch from the daughter board, the daughter board can be easily quickly removed from the connector for maintenance and the like.

Another object of the present invention is to provide an electronic connector including a plurality of contact terminals each contact terminal having an arcuately bending portion provided with an arcuate cross section for smoothly inserting the daughter board into the connector socket to be clamped by the contact terminals without wearing and damaging the terminal pads formed on the daughter board.

DETAILED DESCRIPTION

Figure 1:
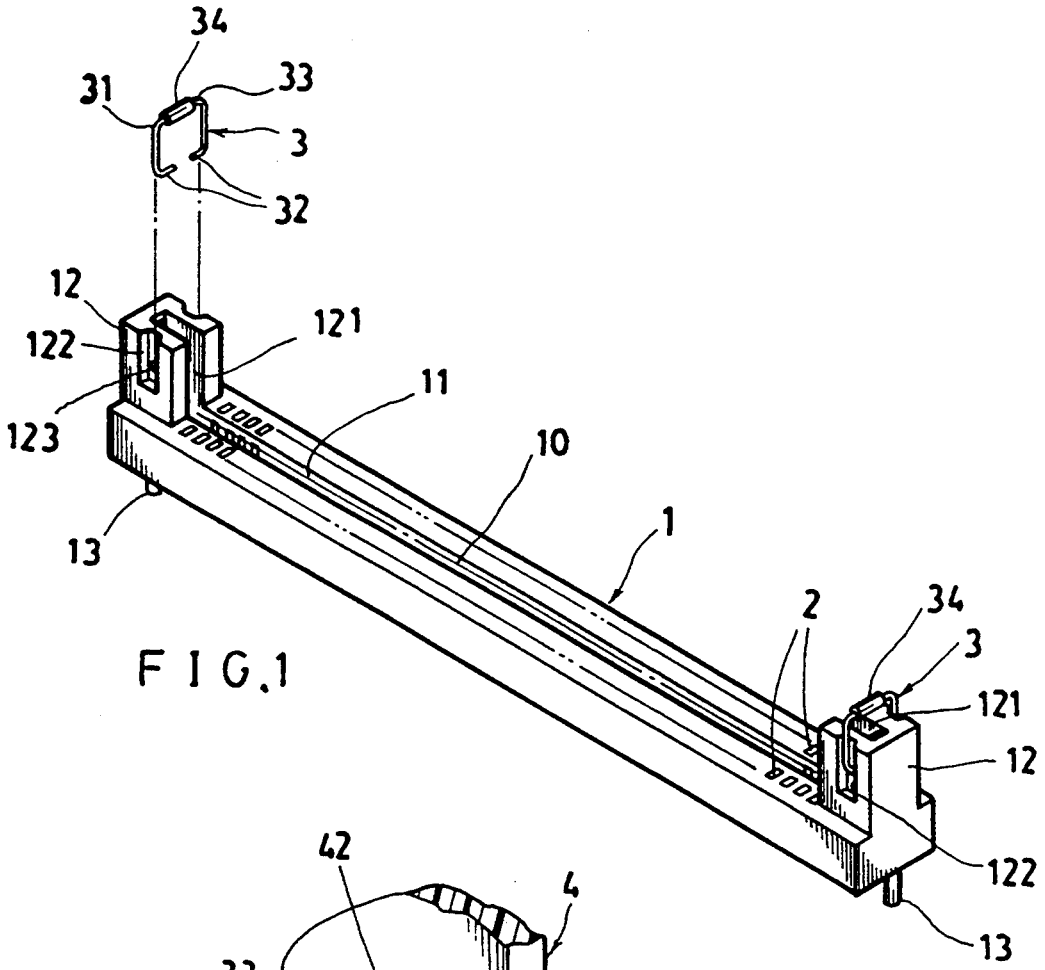
FIG. 1 is a perspective view of the present invention.
Figure 2:
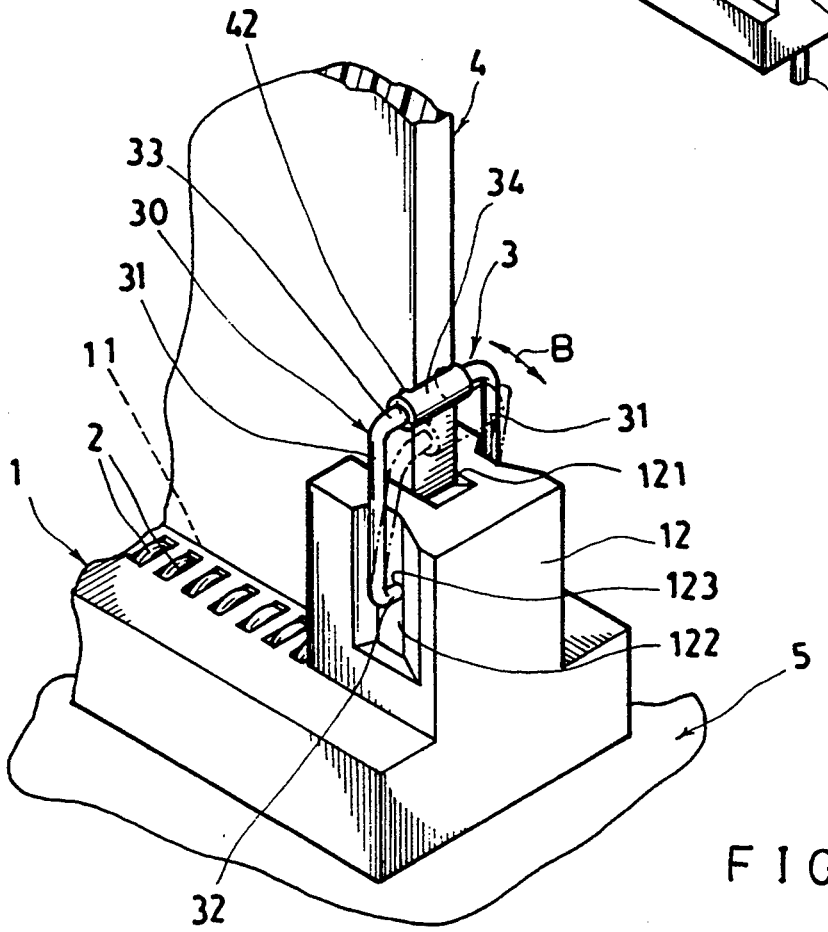
FIG. 2 is a partial perspective view of the present invention.
Figure 3:
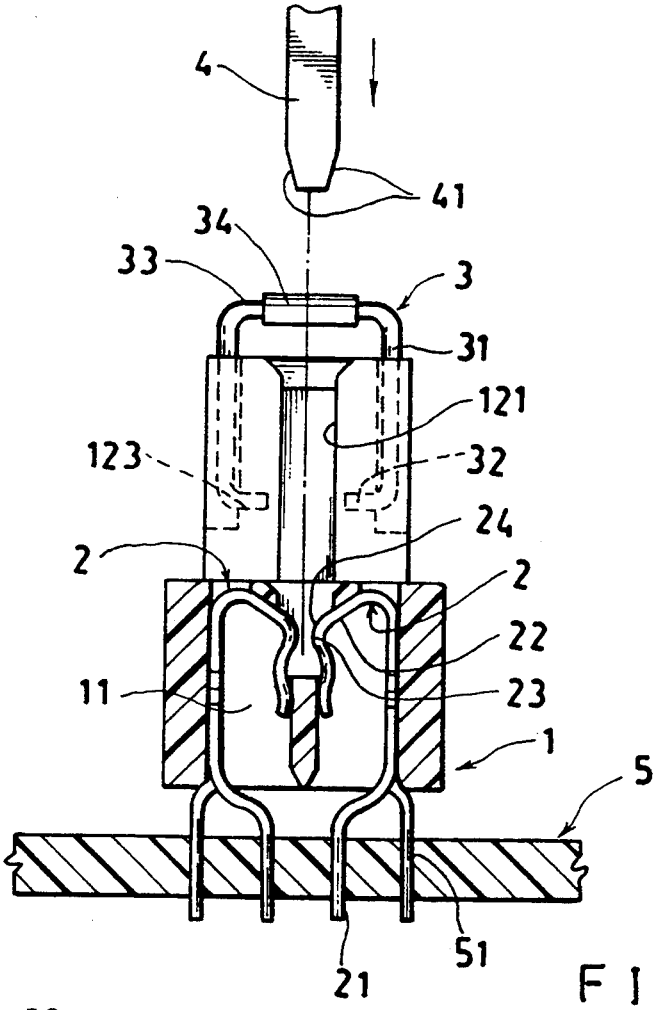
FIG. 3 is a longitudinal sectional view of the present invention.

As shown in FIGS. 1–5, the present invention comprises: an electronic connector 1 having a plurality of contact terminals 2 embedded in the connector 1, and a pair of pivotal latches 3 pivotaly secured on two opposite end portions of the connector 1 for clamping a daughter printed circuit board 4 which is inserted in the connector 1 for electrically connecting a mother printed circuit board 5 secured under the connector 1.

The electronic connector 1 includes: a longitudinal socket 11, longitudinally recessed in the connector 1 about a longitudinal axis 10 defined at a central portion of the connector 1, for juxtapositionally embedding or fixing a plurality of contact terminals 2 into the longitudinal socket 11 having each pair of contact terminals 2 transversely disposed in the socket 11 for clamping the daughter printed circuit board 4 when the daughter printed circuit board 4 is inserted into the longitudinal socket 11 in the connector 1, a pair of holding bases 12 respectively formed on two opposite end portions of the connector 1 each holding base 12 adapted for securing each pivotal latch 3 therein, and two connector leg members 13 disposed on two opposite side portions on a bottom of the connector 1 and engageable with two leg openings (not shown) formed in the mother printed circuit board 5 for mounting the connector 1 on the mother printed circuit board 5.

Each holding base 12 includes: a side socket 121 recessed in an inner side portion of the holding base 12 and communicating with the longitudinal socket 11 of the connector 1 for engaging a side portion of the daughter printed circuit board 4 when inserted in the longitudinal socket 11 of the connector 1, two bracket grooves 122 respectively vertically recessed in a front and a rear side portion of the holding base 12 for movably holding two vertical arm portions 31 of each pivotal latch 3 in the two bracket grooves 122, and two shaft holes 123 each shaft hole 123 drilled in a lower portion of each bracket groove 122.

Each pivotal latch 3 includes: a bracket 30 generally U shaped having two vertical arm portions 31 protruding downwardly from an upper horizontal rod portion 33 to be movably held in the two bracket grooves 122 recessed in each holding base 12, two shaft portions 32 with each shaft portion 32 bent inwardly from each vertical arm portion 31 to be generally perpendicular to each vertical arm portion 31 and pivotaly engageable with each shaft hole 123 drilled in the holding base 12, and a cylindrical member 34 disposed around the upper horizontal rod portion 33 and engageable with each side arcuate recess 42 recessed in a side edge portion of the daughter printed circuit board 4 inserted in the socket 11 of the connector 1.

Figure 4:
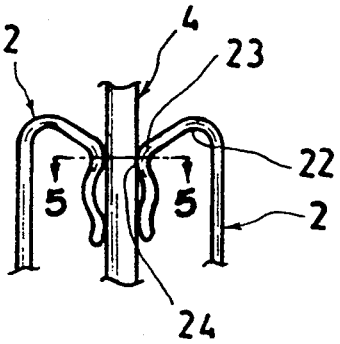
FIG. 4 is an illustration showing a daughter board clamped by a pair of contact terminals in accordance with the present invention.
Figure 5:
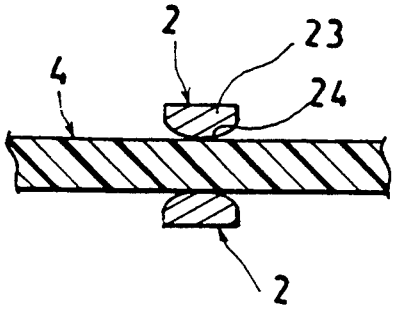
FIG. 5 is a cross sectional drawing of the present invention when viewed from 5—5 direction of FIG. 4.

Each contact terminal 2 includes: a supporting leg member 21 protruding downwardly from an upper clamping portion 22 of the contact terminal 2 and inserted into each leg hole 51 drilled in the mother printed circuit board 5, and at least an arcuately bending portion 23 protruding towards a central portion in the longitudinal socket 11 of the connector 1 to be projectively perpendicular to the longitudinal axis 10 of the longitudinal socket 11, with the arcuately bending portion 23 having a cross section of arcuate shape having a convex portion 24 facing to and slidably contacting a plurality of terminal pads 41 formed on a lower edge portion of the daughter printed circuit board 4 as shown in FIG. 4, 5 for smoothly guiding, inserting the daughter board 4 into the socket 11 to be clamped by each pair of contact terminals 2 embedded or fixed in the socket 11 of the connector 1 for electrically connecting the daughter board 4 with the mother board 5 through each contact terminal 2 in the connector 1.

Upon insertion of the daughter board 4 into the connector socket 11, the two latches 3 may be pivoted about each pair of shaft portions 32 pivoted in the shaft holes 123 in each holding base 12 of the connector 1 to allow each cylindrical member 34 on each latch 3 to engage each side arcuate recess 42 notched in each side edge portion of the daughter board 4. When it is intended to remove the daughter board 4 from the connector for maintenance, for instance, the upwardly withdrawing of the daughter board 4 will automatically thrust the latch 3 sidewardly outwardly as shown in direction "B" for a smooth and quicker dismantling of the daughter board 4 from the connector 1 since an arcuate or circular surface of the cylindrical member 34 is smoothly engageable with the arcuate recess 42. Accordingly, the engagement and the disengagement between the latches 3 and the board 4 will become easier, quicker and convenient, helpful for an assembly of the daughter board 4 on the connector 1 and also helpful for a removal of the board 4 from the connector 1.

The present invention may be modified without departing from the spirit and scope of this invention. The shapes and orientations of each contact terminal 2 are not limited in this invention. Even though the connector 1 of this invention may be used for a dual-inline-package (DIP) memory module socket, it may also be used in a single-inline memory module (SIMM) socket, not limited in this invention.

Figure 7:
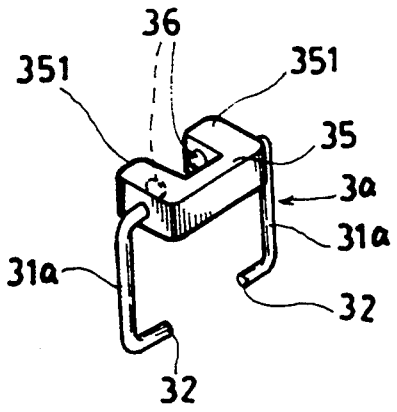
FIG. 7 is a perspective view of another preferred pivotal latch of the present invention.
Figure 6:
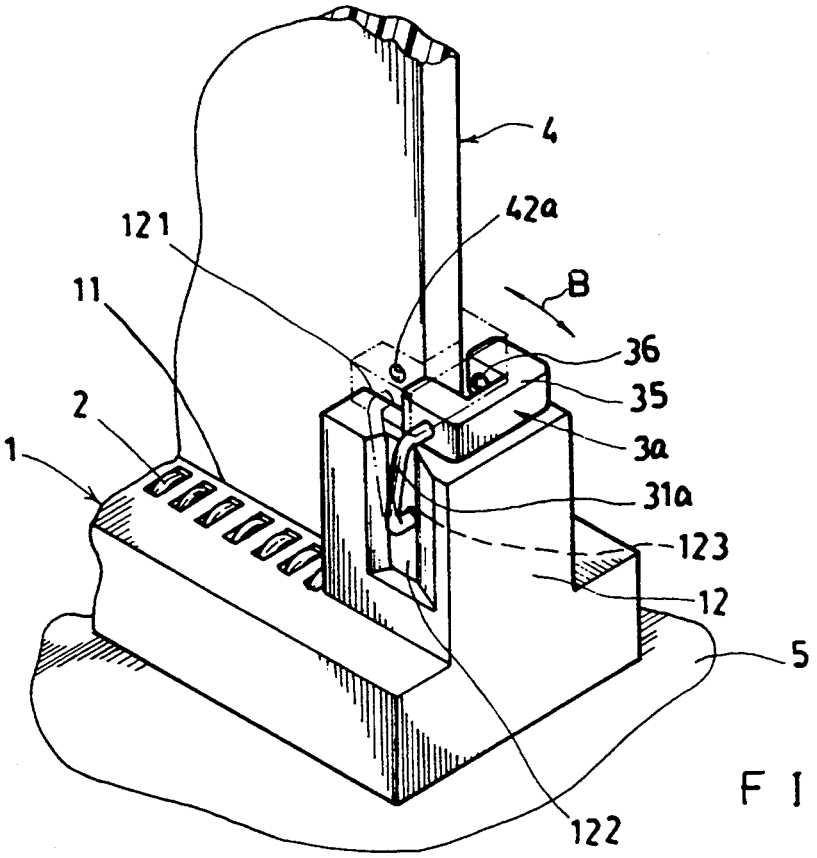
FIG. 6 shows another preferred embodiment of the present invention.

Another preferred embodiment of the present invention is shown in FIGS. 6, 7, in which each pivotal latch 3*a* has been modified to include: a clamping member 35 generally U shaped and having a pair of protrusions 36 protruding inwardly from two bifurcated arm portions 351 of the clamping member 35 to face with each other and to be snugly engageable with a side opening 42*a* drilled through each side edge portion of the daughter printed circuit board 4 for clamping each side edge portion (right side or left side edge portion) of the daughter board 4 in the bifurcated arm portions 351 of the pivotal latch 3*a*, and a pair of arm members 31*a* protruding downwardly from the clamping member 35, a pair of shaft portions 32 each bent inwardly from and perpendicular to each arm member 31*a* to be pivotaly engageable with each shaft hole 123 in the holding base 12 for firmly clamping the daughter board 4 in between the two latches 3*a* when the board 4 is inserted in the socket 11 of the connector 1.

Upon pivotal biasing movement of each pivotal latch 3*a* on each holding base 12, the daughter board 4 can be engageably assembled into the connector 1 or be disengaged from connector 1 for removing the board 4 for maintenance purpose.

I claim:

1. An electronic connector comprising:

a plurality of contact terminals (2) juxtapositionally embedded in a longitudinal socket (11) recessed in a connector (1) for contacting a daughter printed circuit board (4) inserted in said longitudinal socket (11) for electrically connecting said daughter printed circuit board (4) with a mother printed circuit board (5) secured under said connector (1);

said connector (1) having two holding bases (12) disposed on two opposite end portions of said connector (1); and two pivotal latches (3) each pivotal latch (3) pivotaly mounted in each said holding base (12), said two pivotal latches (3) clamping said daughter printed circuit board (4) therebetween;

the improvement which comprises: each said holding base (12) including: a side socket (121) recessed in an inner side portion of the holding base (12) and communicating with the longitudinal socket (11) of the connector (1) for engaging a side portion of the daughter printed circuit board (4) when inserted in the longitudinal socket (11) of the connector (1), two bracket grooves (122) respectively vertically recessed in a front and a rear side portion of the holding base (12), and two shaft holes (123) each shaft hole (123) drilled in a lower portion of each bracket groove (122); and each said pivotal latch (3) including: a bracket (30) generally U shaped having two vertical arm portions (31) protruding downwardly from an upper horizontal rod portion (33) to be movably held in said two bracket grooves (122) recessed in each said holding base (12), two shaft portions (32) with each shaft portion (32) bent inwardly from each said vertical arm portion (31) to be generally perpendicular to each said vertical arm portion (31) and pivotaly engageable with each said shaft hole (123) drilled in the holding base (12), and a cylindrical member (34) disposed around the upper horizontal rod portion (33) and engageable with a side arcuate recess (42) recessed in a side edge portion of the daughter printed circuit board (4) inserted in the socket (11) of the connector (1) for holding said daughter printed circuit board (4) in said connector (1) as clamped in between said two pivotal latches (3).

2. An electronic connector according to claim 1, wherein each said contact terminal (2) includes: a supporting leg member (21) protruding downwardly from an upper clamping portion (22) of the contact terminal (2) and fixed into said mother printed circuit board (5), and at least an arcuately bending portion (23) protruding towards a central portion in the longitudinal socket (11) of the connector (1) to be projectively perpendicular to the longitudinal axis (10) of the longitudinal socket (11); the improvement which comprises: said arcuately bending portion (23) having a cross section of arcuate shape having a convex portion (24) facing to and slidably contacting a plurality of terminal pads (41) formed on a lower edge portion of the daughter printed circuit board (4) for smoothly inserting the daughter printed circuit board (4) into the socket (11) to be clamped by a pair of said contact terminals (2) embedded in the socket (11) of the connector (1) for electrically connecting the daughter printed circuit board (4) with the mother printed circuit board (5) through each said contact terminal (2) in the connector (1).

3. An electronic connector comprising:

a plurality of contact terminals (2) juxtapositionally embedded in a longitudinal socket (11) recessed in a connector (1) for contacting a daughter printed circuit board (4) inserted in said longitudinal socket (11) for electrically connecting said daughter printed circuit board (4) with a mother printed circuit board (5) secured under said connector (1);

said connector (1) having two holding bases (12) disposed on two opposite end portions of said connector (1); and two pivotal latches (3*a*) each pivotal latch (3*a*) pivotaly mounted in each said holding base (12), said two pivotal latches (3*a*) clamping said daughter printed circuit board (4) therebetween;

the improvement which comprises: each said holding base (12) including: a side socket (121) recessed in an inner side portion of the holding base (12) and communicating with the longitudinal socket (11) of the connector (1) for engaging a side portion of the daughter printed circuit board (4) when inserted in the longitudinal socket (11) of the connector (1), two bracket grooves (122) respectively vertically recessed in a front and a rear side portion of the holding base (12), and two shaft holes (123) each shaft hole (123) drilled in a lower portion of each bracket groove (122); and each said pivotal latch (3*a*) including: a clamping member (35) generally U shaped and having a pair of protrusions (36) protruding inwardly from two bifurcated arm portions (351) of the clamping member (35) to face with each other and to be snugly engageable with a side opening (42*a*) drilled through a side edge portion of the daughter printed circuit board (4) for clamping each side edge portion of the daughter printed circuit board (4) in the bifurcated arm portions (351) of the pivotal latch (3*a*), a pair of arm members (31*a*) protruding downwardly from the clamping member (35), and a pair of shaft portions (32) each shaft portion bent inwardly from and perpendicular to each said arm member (31*a*) to be pivotaly engageable with each shaft hole (123) in the holding base (12) for firmly clamping the daughter printed circuit board (4) in between the two latches (3*a*) when said daughter printed circuit board (4) is inserted in the socket (11) of the connector (1), whereby upon pivotal biasing movement of each said pivotal latch (3*a*) on each said holding base (12), the daughter printed circuit board (4) can be engageably assembled into the connector (1) or disengaged from the connector.

4. An electronic connector according to claim 3, wherein each said contact terminal (2) having an upper clamping portion (22) contacting with the daughter printed circuit board (4) and having a cross section of arcuate shape (24) for smoothly contacting said daughter printed circuit board (4).

* * * * *